United States Patent [19]

Kinsey et al.

[11] 4,392,357

[45] Jul. 12, 1983

[54] METHOD AND MEANS CONTROLLING DEFROST CYCLES OF A COOLING UNIT

[75] Inventors: Brian D. Kinsey; Steven W. Smock, both of Indianapolis, Ind.

[73] Assignee: Emhart Industries, Inc., Indianapolis, Ind.

[21] Appl. No.: 257,870

[22] Filed: Apr. 27, 1981

[51] Int. Cl.[3] ..... F25D 21/06

[52] U.S. Cl. ..... 62/153; 62/155; 62/234

[58] Field of Search ..... 62/153, 154, 155, 234; 200/38 R, 38 A, 38 B, 38 BA, 33 R

[56] References Cited

U.S. PATENT DOCUMENTS

| | | | |
|---|---|---|---|
| 2,459,083 | 1/1949 | McCloy | 62/153 |
| 2,737,025 | 3/1956 | Soreng et al. | 62/153 |
| 3,518,841 | 7/1970 | West, Jr. | 62/153 |
| 3,727,015 | 4/1973 | Voland et al. | 200/38 R |

*Primary Examiner*—Albert J. Makay
*Assistant Examiner*—Harry Tanner
*Attorney, Agent, or Firm*—Robert F. Meyer; David W. Gomes

[57] ABSTRACT

The time between constant speed defrost cycles is shortened by monitoring the opening and closing of a door of a cooling unit. The control system for doing so includes cam means rotating at a constant speed and electrical switches responsive thereto, a ratchet with missing teeth coupled to the cam means, a pawl engaging the door and the ratchet.

7 Claims, 4 Drawing Figures

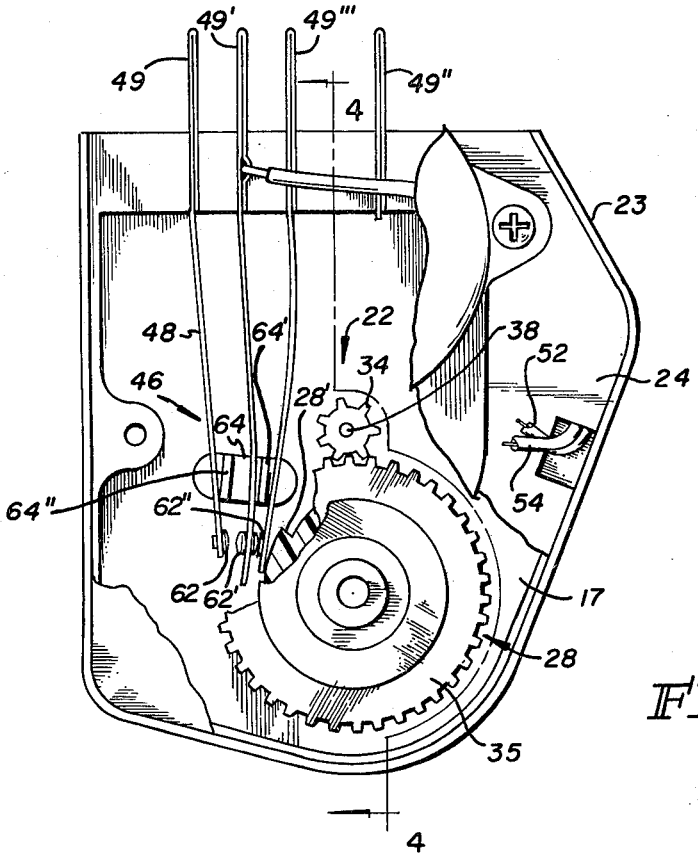
FIG. 3
FIG. 4
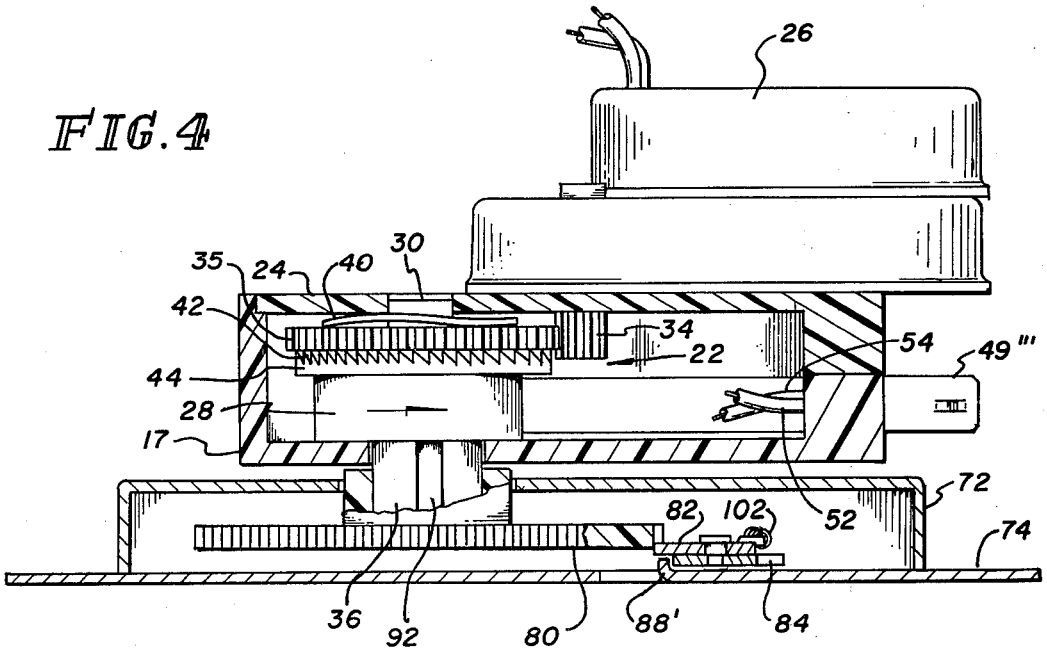

METHOD AND MEANS CONTROLLING DEFROST CYCLES OF A COOLING UNIT

BACKGROUND OF THE INVENTION

Generally speaking, the present invention relates to a method of defrosting a cooling unit which includes the steps of providing constant defrost cycle times of predetermined time lengths apart and monitoring openings and closings of a door of the cooling unit to shorten the time lengths in accordance with each of the openings and closings.

A control system for carrying out the method of the invention comprises, in general, defrost means; cam means, constant speed drive means coupled to the cam means, and switch means responsive to the cam means controlling electrical current to the defrost means; and monitoring means coupled to the cam means and responsive to openings and closings of a door of a cooling unit to intermittently advance the cam means so as to shorten time lengths between defrost cycles.

The present invention pertains to a control system for defrosting a cooling unit and more particularly to such a system wherein defrost cycle times are determined by a constant speed timing mechanism.

Present day cooling units, such as refrigerators, utilize timing mechanisms which are driven at a constant speed to provide defrost cycles for the unit. Such mechanisms have a shortcoming in that the defrost cycles provided by a constant speed timing mechanism does not compensate for consumer usage of the refrigerator. More specifically, the constant speed timing mechanism is, for the most part, programmed to provide a constant cycle of 30 minute defrost heater on time following a 5½ or 11½ hour compressor run time. The cycle is based on an average usage rate and thus is not sensitive to low or heavy demand periods. Thus, if the refrigerator is used very little and door openings are kept to a minimum, relatively little frost accumulates on the refrigerator coolant coils and thus the defrost heater need not be cycled as frequently. With a defrost heater drawing 1500 watts of power and the associated cool down by the compressor requiring 700 watts, needless energy is consumed.

Accordingly, the present invention is directed to a control system and a method of defrosting a cooling unit such as a refrigerator that relies on the amount of door openings and closings of the refrigerator.

OBJECTS OR FEATURES OF THE INVENTION

It is, therefore, a feature of the present invention to provide a control system for controlling defrost cycles of a cooling unit. Another feature of the invention is to provide such a control system which utilizes a constant speed timing mechanism to provide defrost cycles with predetermined periods of time between the cycles. Another feature of the invention is to provide such a system wherein door openings and closings are used to shorten the predetermined time periods between cycles. Yet another feature of the invention is to provide such a mechanism wherein there is a monitoring means coupled to the constant speed timing mechanism and which is responsive to openings and closings of the door of the cooling unit. Still another feature of the invention is to provide such a system wherein the monitoring means includes a ratchet that is coupled to cam means of a constant speed timing mechanism and a pawl driving the ratchet in response to the openings and closings.

These and other features of the invention will be apparent from the following description taken in conjunction with the accompanying drawings.

DESCRIPTION OF THE DRAWINGS

FIG. 3 is a side view of a constant speed timing mechanism used in the control system.

FIG. 4 is a view taken along the lines 4—4 of FIG. 3.

DETAILED DESCRIPTION OF THE INVENTION

Figure 1:
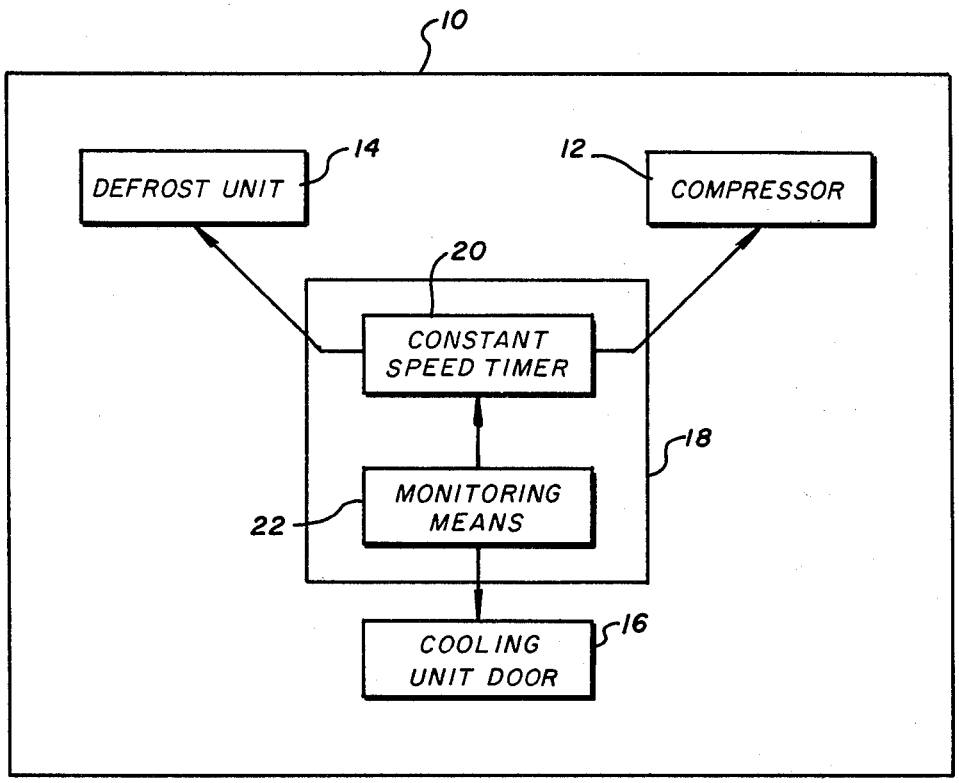
FIG. 1 is a block diagram illustrating the control system of the invention and its relationship to the principal elements of a cooling unit.

Referring now to FIG. 1, a typical cooling unit 10, such as a refrigerator, includes a compressor 12 and a defrost unit 14 which are driven by a motor (not shown) of the cooling unit, and a door 16 for the unit. According to the present invention, a control system 18 is utilized to control both the compressor and the defrost unit. Control system 18 includes a constant speed timer 20 which operates the motor which drives the compressor and the defrost unit, a monitoring means 22 which is responsive to an opening and closing of door 16 to shorten the time between cycles provided by the constant speed timer. More specifically, according to the present invention, since door openings are a measure of consumer usage, every door opening serves to shorten the compressor run time. Therefore, the time between defrost periods is shortened in direct relationship to the number of door openings. Consequently, consumer usage or demand affects how often the defrost unit 14 is cycled.

Figure 2:
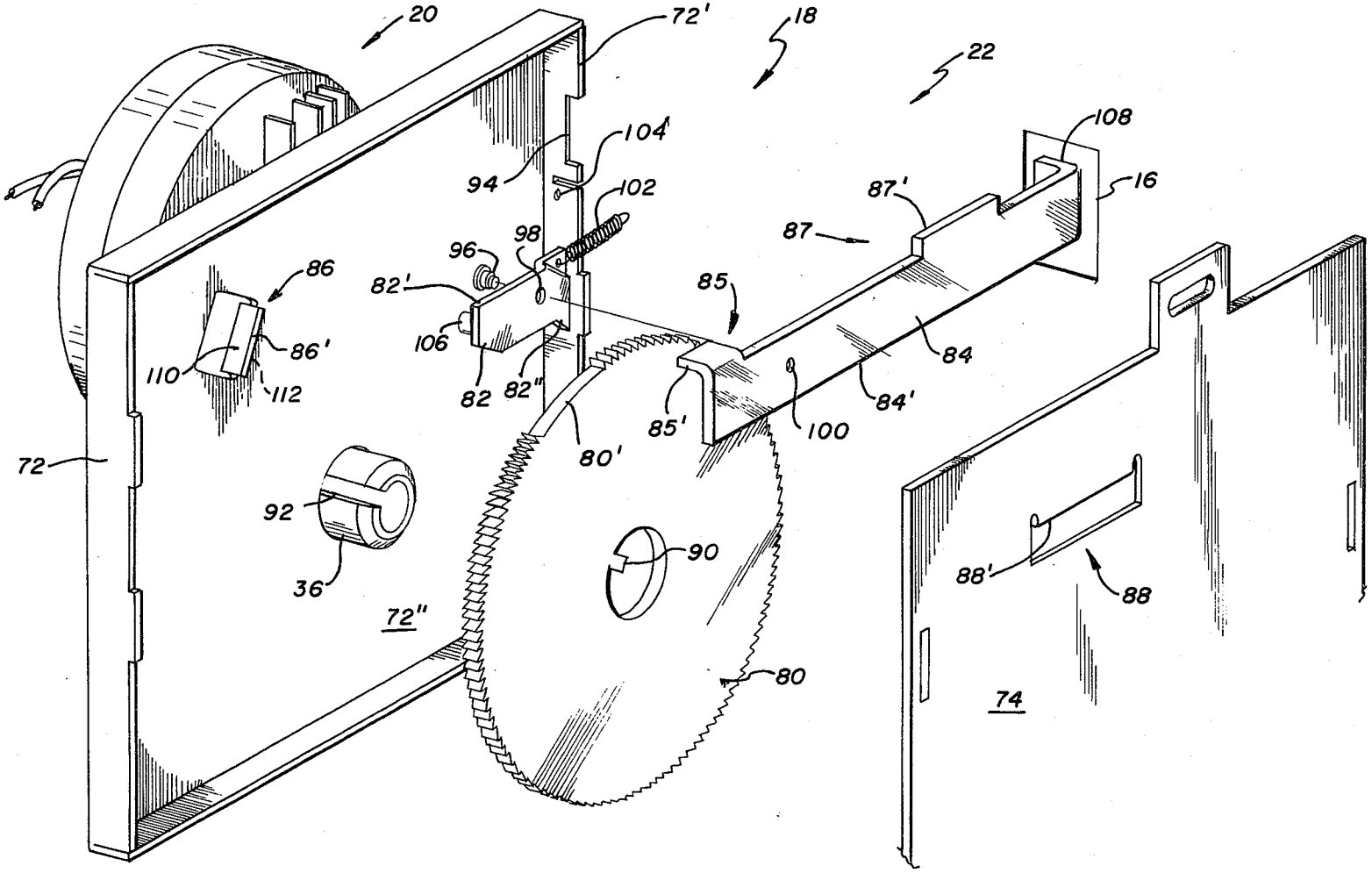
FIG. 2 is an exploded view of the apparatus of the control system.

Referring to FIGS. 2 and 4, the complete control system can be described. Control system 18, in general, includes a constant speed timer 20 and a monitoring means 22 which is responsive to door openings and closings in a manner to be described. Monitoring means 22 is enclosed in a cup-shaped member 72 and a cover 74 and includes a ratchet 80, pawl 82 that is pivotally held on a slider 84, guide means 85 and 88, a stop means 87 and ramp means 86. Ratchet 80 is fixedly carried on hub portion 36 of constant speed timer 20 through a tab 90 which has an interference fit with slot 92 of the hub portion. The ratchet inludes a space 80' where there are no teeth for a purpose to be described hereinafter. Slider 84 slides in notch 94 in wall 72' of cup-shaped member 72 and is held in alignment by guide means 85 and 88. Guide means 85 includes a flange 85' that is bent over from the slider to ride on the base 72'' of the cup-shaped member. As will be apparent hereinafter, the flange 85' also holds pawl 82 in position by virtue of side 82' riding against the underneath side of the flange. Guide means 88 includes a flange 88' that is lanced from cover 74 to provide a shelf upon which edge 84' of the slider rides. Stop means 87, which inludes a projection 87', engages wall 72' of the cup-shaped member to limit movement of slider 84. Wall 72' can be adjusted through bending of the wall to control the length of travel of the slider.

Pawl 82 is pivotally mounted on slider 84 through a post 96 which extends through aperture 98 to engage aperture 100 in the slider. The pawl is spring biased toward the teeth of ratchet 80 through coil tension spring 102, an end of which engages aperture 104. As will be apparent, spring 102 also aids in advancing ratchet 80 and holds slider 84 against the door of the cooling unit. The pawl pivots in response to ramp means 86 which includes a tang or ramp 86' lanced from base 72" and which is engaged by post 106 extending from the pawl.

In operation, assuming door 16 of a refrigerator is closed, slider 84 will be braced against the door through flange 108 by virtue of spring 102 being in tension and pawl 82 being mounted on the slider. When door 16 is opened, slider 84 begins to move outward with the door. Post 106 engages the front surface 110 of ramp 86' and ramps pawl 82 and slider 84 up surface 110 and thus away from ratchet 80 until the post 106 drops off the ramp 86' which allows tooth 82" to engage ratchet 80. The tension in spring 102 advances ratchet 80 to rotate hub 36 until projection 87' engages wall 72'. Upon closing the door, slider flange 108 engages door 16. Door 16 drives slider 84 forward into housing 72 and extending tension spring 102. As force is applied to slider 84 by door 16, tooth 82" clicks past ratchet teeth until post 106 engages the underneath surface 112 of ramp. Surface 112 ramps post 106 counterclockwise about post 96 thus disengaging tooth 82" from the ratchet tooth. This counterclockwise motion is controlled by slider edge 84' dropping down and resting against guide means 88' and the bias by spring 102. When slider 84 has travelled far enough, post 106 will ramp down surface 112 and clear the end of it. When post 106 clears ramp 112, pawl 82 will snap up clockwise about post 96. Pawl 82' will stop against guide means flange 85'. The slider is now ready for the next opening of the door. The housing 72 is deep enough to allow a ½" over travel of slider 84. Such over travel accommodates door gasket compression variation and thus insures that the door will close.

Referring now to FIGS. 3 and 4, the constant speed timer 20 can now be described. The constant speed timer is of the type described in U.S. Pat. No. 3,727,015 issued Apr. 10, 1973 to Voland, et al. The various elements of the constant speed defrost timer are enclosed in a housing 23, the housing being formed from a cup-shaped member 17 which is closed by a cover plate 24. A constant speed motor 26 is connected to cover plate 24, the motor being used to drive a cam means 28. Cam means 28 includes oppositely opposed hub portions 30 and 36, the cam means being unitarily constructed with the hub portions. Hub portions 30 and 36 are journalled in cover plate 24 and cup-shaped member 17 respectively. The motor drives cam means 28 through drive means 32. Drive means 32 includes a pinion 34 and a gear 35. Gear 35 "floats" on hub portion 30. Pinion 34 is connected to a shaft 38 of the motor. Spring 40 biases the gear 35 between the cam means 28 and the cover plate 24. Gear 35 has ratchet teeth 42 adapted to mate and engage corresponding ratchet teeth 44 formed on the cam means 28. The ratchet teeth 42 and 44 in combination with spring 40 serves as a clutch to permit overriding of gear 35 and thus motor output pinion 34 and motor 16. Switch means 46, consisting of a plurality of switch blades 48, are responsive to cam means 28 through an arcuate step (not shown) that consists of a constantly rising lobe ending in a sudden drop. Terminals 49, which extend from switch blade 48, are used to complete electrical circuits to defrost unit 14 and compressor 12. Lead 52 and another connect the constant speed motor 26 to the switch blades.

Switch blades 48 each carry electrical contacts 62, 62' and 62" such that when the contacts are brought together in a predetermined sequence, an electrical circuit can be completed through the blades and the electrical terminals. The blades are separated by a slideable separating means 64 which is mounted in suitable apertures formed in the blades. Rotation of cam means 28 causes the contacts 62, 62' and 62" to be engaged in a predetermined programmed sequence.

Having described the various elements of the constant defrost timer, its operation can now be discussed. Although not shown for both, motor leads 52 and 54 are electrically connected to electrical terminals 49' and 49", the terminals being electrically connected to a power source. Such power source is within the refrigerator, for example, the refrigerator motor. Thus the motor for the timer is constantly running so long as the compressor is running. For safety purposes, there is also a ground wire connection (not shown) attached to the housing 12. The timing mechanism is so constructed so as to alternately operate, in a predetermined cycle, compressor 12 for the refrigerator and defrost unit 14 such as a suitable heating means. Motor 26 drives gear 35 through pinion 34, the gear in turn driving cam means 28 through ratchet teeth 42 and 44. As shown in FIG. 3, contacts 62' and 62" are engaged to complete an electrical circuit through terminal 49'''. Terminal 49''' would complete the electrical circuit to the refrigerator compressor 12, for example, such that when contacts 62' and 62" are engaged, the refrigerator will be in the cooling cycle. Contacts 62' and 62" will be engaged when the contacts are riding on the rise portion of the lobe of cam means 28. Contact 62 will remain separated from contact 62' due to contact blade 48' riding on top of cam lobe 28' and pressing against shoulder 64' on slider 64 thus causing shoulder 64" to press against blade 48 thereby holding contacts 62 and 62' separated. When contact 62" drops off the rise lobe of cam means 28, contacts 62 and 62' will become engaged by virtue of separating means 64 sliding a sufficient amount to allow the contacts to become so engaged. With contacts 62 and 62' engaged, an electrical circuit is completed through terminal 49, terminal 49 being connected to defrost unit 14.

Referring now to FIGS. 2–4, the operation of the complete control system 10 can be described with respect to a refrigerator as the cooling unit. Constant speed timer 20 will alternately operate the compressor and the defrost unit or heater as programmed by cam means 28 and in the manner previously described. If the users are on vacation, for example, and door 16 is closed, the constant speed timer will, during such time, operate the compressor and defrost unit at their normal cycles with the normal predetermined periods of time between each cycle. During this period of time, ratchet 80 of the monitoring means 22 is set such that pawl 22 will engage the ratchet in the no teeth portion 80'. During periods of heavy use, however, when the refrigerator door is opened and closed many times, the time between cycles is shortened by advancing cam means 28 through the monitoring means 22. More specifically, when the door is opened, ratchet 80 will be advanced in the manner previously described, to advance cam means 28 in the direction of the arrow shown in FIG. 4. The motor drive 26 will be overridden by ratchet teeth 42 and 44 being disengaged. The advancement of the cam means will shorten the time between defrost cycles.

Ratchet 80 is located and programmed such that space 80' coincides with defrost periods of constant speed timer 20. That is, tooth 82" of pawl 82 will engage space 80' during defrost periods such that any opening and closing of the door during such time will not cause a shortening of the defrost cycle.

What is claimed is:

1. A control system for controlling defrost cycles of a cooling unit comprising:

(a) defrost means, (b) cam means, constant speed drive means coupled to said cam means, and switch means responsive to said cam means controlling electrical current to said defrost means, and (c) monitoring means coupled to said cam means and responsive to an opening and closing of a door of said cooling unit to intermittently advance said cam means so as to shorten time lengths between defrost cycles comprising a ratchet having a section void of teeth to prevent advancement of the ratchet during a defrost mode of operation, means coupling said ratchet to said cam means, and a pawl engaging said door and said ratchet to advance same in response to an opening of said door.

2. A control system according to claim 1 wherein said monitoring means further comprises an axially movable slider engaging said door, means pivotally mounting said pawl on said slider, ramp means engaging said pawl to pivot same upon movement of said slider, and a tension spring connected to said pawl and mounted so as to cause engagement of said pawl with said ratchet and to hold said slider against said door.

3. A control system according to claim 1 wherein said pawl is mounted to be axially slideable and is axially spring biased.

4. A control system according to claim 1 further including stop means limiting the travel of said pawl.

5. A monitoring means according to claim 2 wherein said ramp means is a tang mounted at an angle to said pawl and wherein a post extends from said pawl and engages each of two opposed surfaces of said tang upon opposite movements of said slider.

6. A monitoring means according to claim 2 further including first guide means engaging said slider to insure a sliding at a predetermined level.

7. A monitoring means according to claim 2 further including second guide means carried by said slider and engaging a housing member for said monitoring means and said pawl to guide both said slider and said pawl.

* * * * *